United States Patent [19]

Olsen et al.

[11] Patent Number: 4,521,161

[45] Date of Patent: Jun. 4, 1985

[54] NOISE CONTROL FOR CONICALLY PORTED LIQUID RING PUMPS

[75] Inventors: Ole B. Olsen, Newtown; Charles W. Bilik, Norwalk; Herbert H. Johnson, Georgetown; Charles M. Jozepaitis, Bridgeport, all of Conn.

[73] Assignee: The Nash Engineering Company, Norwalk, Conn.

[21] Appl. No.: 564,881

[22] Filed: Dec. 23, 1983

[51] Int. Cl.[3] ..... F04C 19/00

[52] U.S. Cl. ..... 417/68

[58] Field of Search ..... 417/68, 69, 313

[56] References Cited

U.S. PATENT DOCUMENTS

| | | | |
|---|---|---|---|
| 1,180,613 | 4/1916 | Siemen | 417/68 |
| 1,322,363 | 11/1919 | Siemen et al. | 417/68 |
| 2,195,174 | 3/1940 | Jennings | 417/68 |
| 2,302,747 | 11/1942 | Dardelet | 417/68 |
| 2,344,396 | 3/1944 | Dardelet | 417/68 |
| 2,453,373 | 11/1948 | Kollsman | 417/68 |
| 3,348,766 | 10/1967 | Mugele | 417/68 |
| 3,352,483 | 11/1967 | Allen | 417/68 |
| 3,366,314 | 1/1968 | Schroder | 417/68 |
| 3,721,508 | 3/1973 | Mugele | 417/68 |
| 3,743,443 | 7/1973 | Jennings | 417/68 |
| 3,884,596 | 5/1975 | Hoffmeister | 417/68 |
| 4,251,190 | 2/1981 | Brown et al. | 417/68 |
| 4,273,515 | 6/1981 | Fitch | 417/68 X |
| 4,392,783 | 7/1983 | Jozepaitis | 417/68 |

FOREIGN PATENT DOCUMENTS

| | | | |
|---|---|---|---|
| 0071715 | 2/1983 | European Pat. Off. | 417/68 |
| 258483 | 4/1913 | Fed. Rep. of Germany | 417/68 |
| 949765 | 9/1956 | Fed. Rep. of Germany | 417/68 |
| 2731451 | 4/1978 | Fed. Rep. of Germany | 417/68 |
| 2704863 | 8/1978 | Fed. Rep. of Germany | 417/68 |
| 1249020 | 11/1960 | France | 417/68 |
| 555428 | 6/1978 | Japan | 417/68 |
| 5587885 | 12/1978 | Japan | 417/68 |
| 55-5427 | 1/1980 | Japan | 417/68 |
| 73493 | 7/1926 | Sweden | 417/68 |
| 11378 | of 1906 | United Kingdom | 417/68 |
| 2064002A | 6/1981 | United Kingdom | 417/68 |

*Primary Examiner*—William L. Freeh
*Assistant Examiner*—Paul F. Neils
*Attorney, Agent, or Firm*—Robert R. Jackson; David W. Plant

[57] ABSTRACT

In liquid ring pumps having conical port members, cavitation and associated operating noise are reduced by providing a second subsidiary discharge port beyond the closing edge of the main discharge port in the direction of rotor rotation.

7 Claims, 5 Drawing Figures

12
14
16
18
20
22
24
28
30
32
34
36
38
40
50
52
54
58
60
64
68
70
80
82
90
94
98
104
108
110
2
2

Fig. 3.
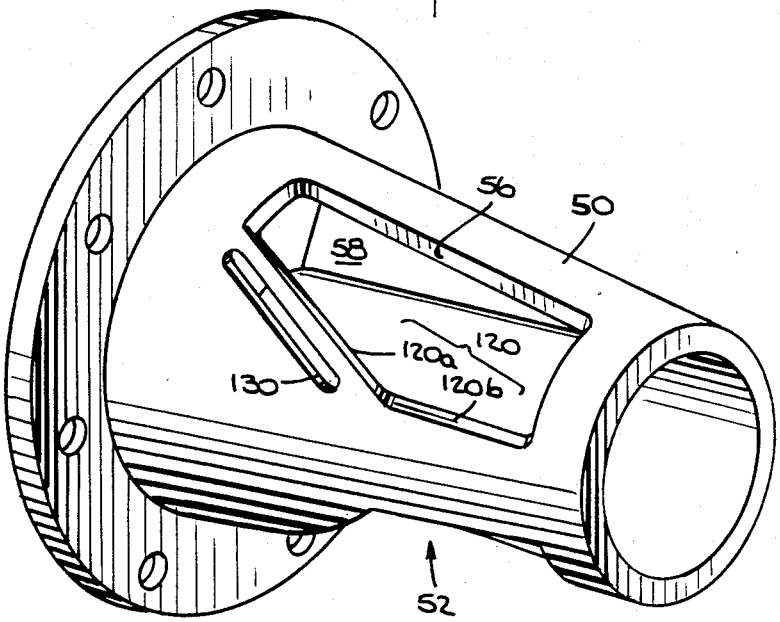
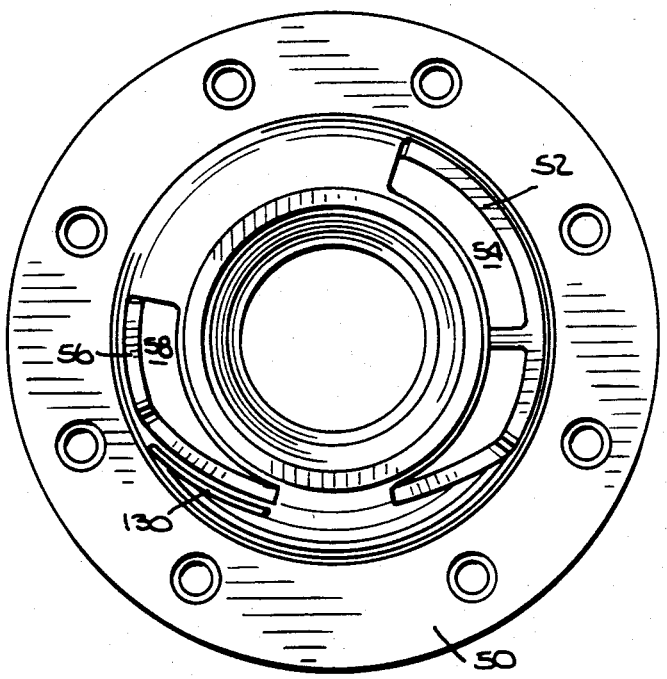
Fig. 4.

NOISE CONTROL FOR CONICALLY PORTED LIQUID RING PUMPS

BACKGROUND OF THE INVENTION

This invention relates to liquid ring pumps, and more particularly to reducing cavitation and its associated operating noise in liquid ring pumps, especially those having conical port members.

A typical liquid ring pump having conical port members is shown in Adams U.S. Pat. No. 3,289,918. Although the port members in pumps of the type shown in the Adams patent are actually frusto-conical, those skilled in the art usually refer to such port members as conical, and that terminology is also sometimes employed herein.

Cavitation sometimes occurs in conically ported liquid ring pumps, particularly those which are operated at high speeds and/or at low intake pressures (i.e., intake pressures near zero absolute pressure). Cavitation is believed to be caused by the sudden collapse or implosion of vapor bubbles in the pumping liquid (usually water) which constitutes the liquid ring. Vapor bubbles may be formed on the intake side of the pump and carried over to the compression side of the pump where they suddenly collapse as they approach the rotor or port member. Vapor bubbles may also be formed on the compression side of the pump where the pumping liquid approaches the rotor hub and port member and is therefore abruptly redirected. The after-effects of the sudden collapse of these vapor bubbles may be audible outside the pump and may undesirably or objectionably contribute to the operating noise level of the pump.

It is therefore an object of this invention to reduce cavitation in liquid ring pumps having conical port members.

It is another object of this invention to reduce the operating noise levels of liquid ring pumps having conical port members by reducing the noise associated with cavitation in the pumps.

SUMMARY OF THE INVENTION

These and other objects of the invention are accomplished in accordance with the principles of the invention by providing a liquid ring pump including a first main discharge port with a closing edge having a segment which is inclined in the direction of rotor rotation from a first relatively large circumference portion of the conical port member to a second relatively small circumference portion of the port member, and a second subsidiary discharge port beyond the inclined segment in the direction of rotor rotation.

Further features of the invention, its nature and various advantages will be more apparent from the accompanying drawing and the following detailed description of the invention.

BRIEF DESCRIPTION OF THE DRAWINGS

FIG. 3 is a perspective view of the first stage port member in the pump of FIGS. 1 and 2.

FIG. 4 is an end view of the port member of FIG. 3.

DETAILED DESCRIPTION OF THE INVENTION

Figure 1:
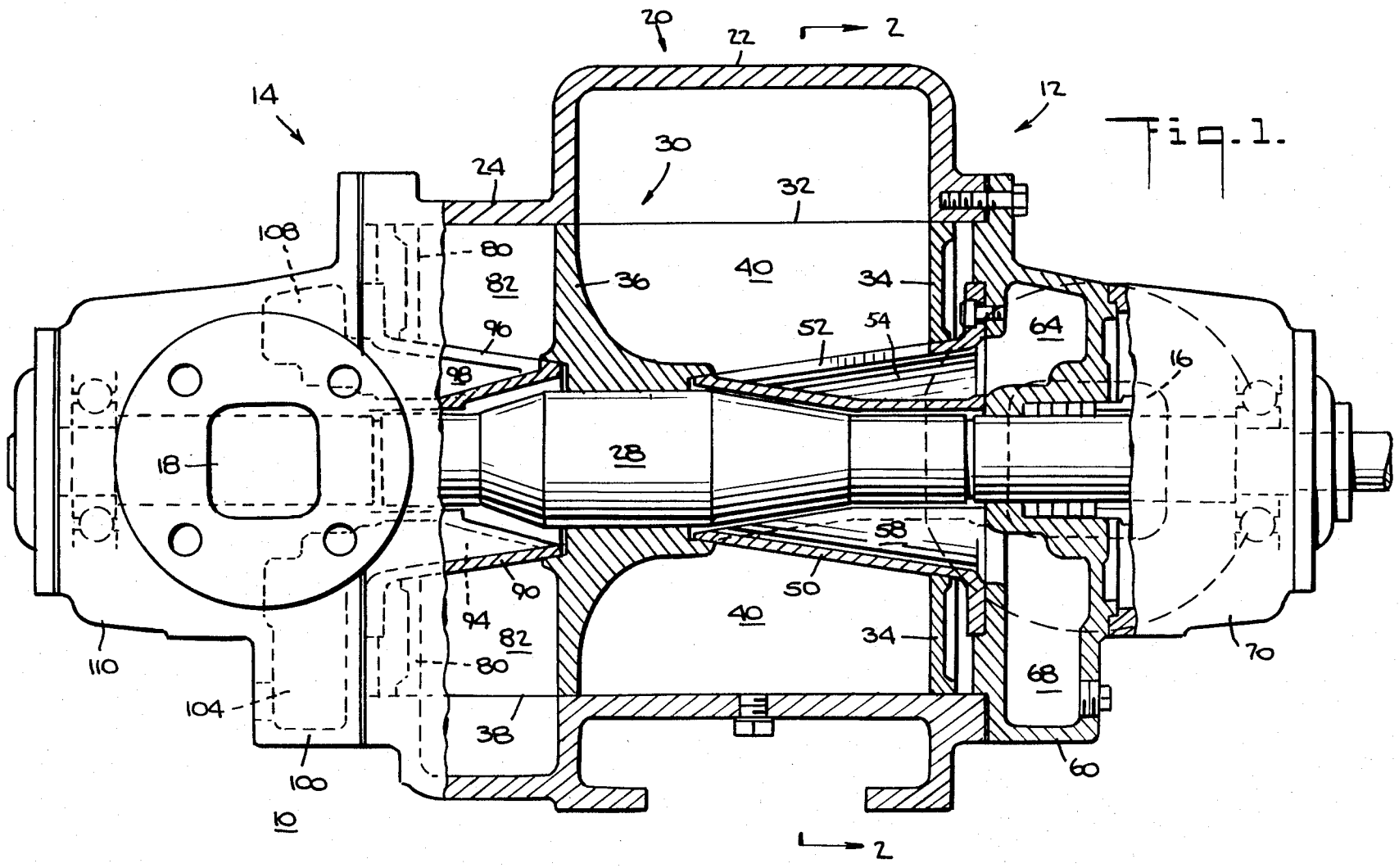
FIG. 1 is an elevational view, partly in section, of an illustrative conically ported two-stage liquid ring pump constructed in accordance with the principles of the invention.

The liquid ring pump 10 shown in the drawings is a two-stage pump having a first stage 12 on the right in FIG. 1 and a second stage 14 on the left in that Figure. Gas or vapor to be pumped (hereinafter generically referred to as gas) enters the pump via inlet opening 16 and, after successively passing through the first and second stages, exits from the pump via outlet opening 18.

The pump has a generally annular housing 20 including a first stage portion 22 and a second stage portion 24. Rotatably mounted in housing 20 is a shaft 28 and a rotor 30 fixedly mounted on the shaft. Rotor 30 has a first stage portion 32 extending from annular end shroud 34 to annular interstage shroud 36. Rotor 30 also has a second stage portion 38 extending from interstage shroud 36 to annular end shroud 80. Circumferentially spaced, radially extending, first stage rotor blades 40 extend from interstage shroud 36 to end shroud 34. Circumferentially spaced, radially extending, second stage rotor blades 82 extend from interstage shroud 36 to end shroud 80.

Adjacent to end shroud 34, rotor 30 has a first frusto-conical bore concentric with shaft 28. Frusto-conical first stage port member 50 (sometimes referred to for convenience here as conical port member 50) extends into this bore between shaft 28 and rotor 30. Port member 50 is fixedly connected to first stage head member 60, which is in turn fixedly connected to housing 2. Bearing assembly 70 is fixedly connected to head member 60 for rotatably supporting shaft 28 adjacent the first stage end of the pump.

Adjacent to end shroud 80 a second frusto-conical port member 90 extends into a second frusto-conical bore in rotor 30. Port member 90 is concentric with shaft 28 and is fixedly mounted on second stage head member 100, which is in turn fixedly mounted on housing 20. Bearing assembly 110 is fixedly mounted on head member 100 for rotatably supporting shaft 28 adjacent the second stage end of the pump.

First stage housing portion 22 is eccentric to first stage rotor portion 32, and second stage housing portion 24 is similarly eccentric to second stage rotor portion 38. Both portions of housing 20 are partially filled with pumping liquid (usually water) so that when rotor 30 is rotated, the rotor blades engage the pumping liquid and cause it to form an eccentric ring of recirculating liquid in each of the two stages of the pump. In each stage of the pump this liquid cyclically diverges from and then converges toward shaft 28 as rotor 30 rotates. Where the liquid is diverging from the shaft, the resulting reduced pressure in the spaces between adjacent rotor blades constitutes a gas intake zone. Where the liquid is converging toward the shaft, the resulting increased pressure in the spaces between adjacent rotor blades constitutes a gas compression zone.

Figure 2:
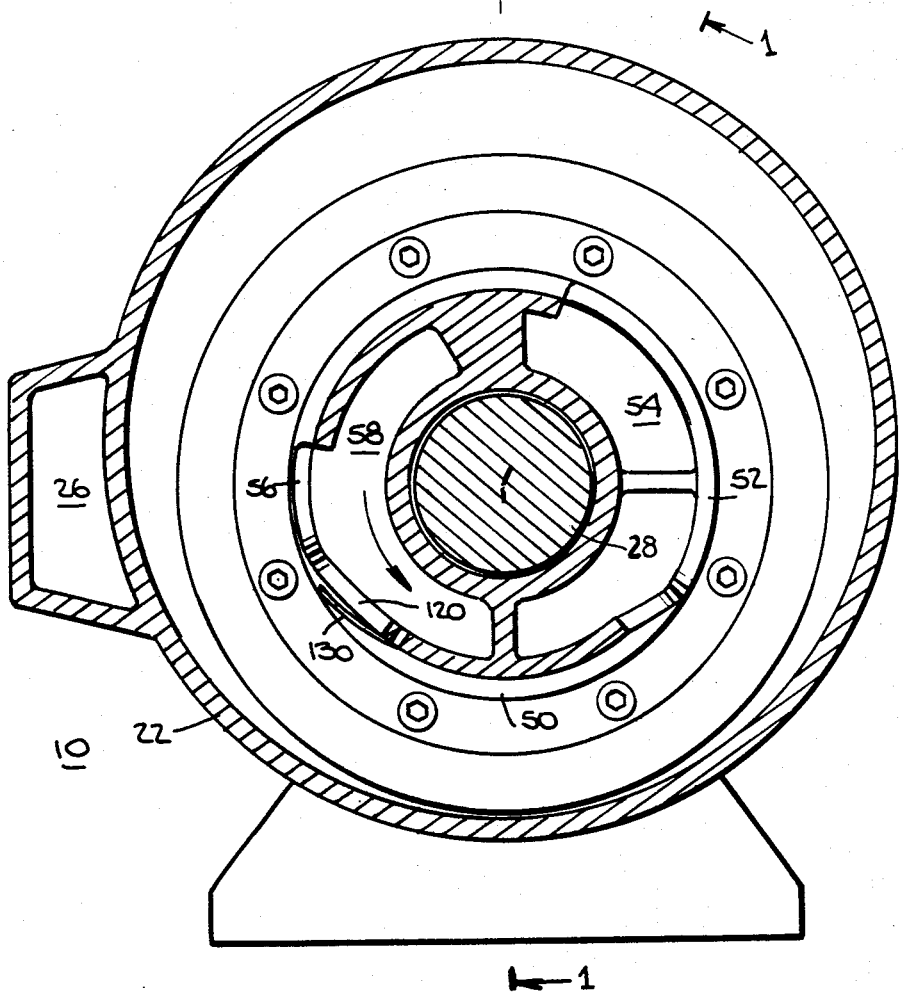
FIG. 2 is a cross-sectional view taken along the line 2—2 in FIG. 1, but with the rotor of the pump removed.

First stage port member 50 includes an inlet port 52 for admitting gas to the intake zone of the first stage of the pump. Port member 50 also includes a discharge port 56 for allowing compressed gas to exit from the compression zone of the first stage. Gas is conveyed from inlet opening 16 to inlet port 52 via conduit 64 in head member 60 and conduit 54 in port member 50. Gas discharged via discharge port 56 is conveyed from the first stage via conduit 58 in port member 50 and conduit 68 in head member 60. This gas is conveyed from first stage head member 60 to second stage head member 100 via interstage conduit 26 (FIG. 2) which is formed as part of housing 20.

Second stage port member 90 includes an inlet port (not shown) for admitting gas to the intake zone of the second stage of the pump, and a discharge port 96 for allowing gas to exit from the second stage compression zone. Gas is conveyed from interstage conduit 26 to the second stage inlet port via conduit 104 in head member 100 and conduit 94 in port member 90. Gas discharged via second stage discharge port 96 is conveyed to outlet opening 18 via conduit 98 in port member 90 and conduit 108 in head member 100.

As is conventional in two-stage liquid ring pumps, the first stage discharge pressure (which is approximately equal to the second stage intake pressure) is substantially greater than the first stage intake pressure, and the second stage discharge pressure is substantially greater than the second stage intake pressure. For example, in a typical vacuum pump installation, the first stage intake pressure is near zero absolute pressure, the second stage discharge pressure is atmospheric pressure, and the interstage pressure (i.e., the first stage discharge and second stage intake pressure) is intermediate these other pressures.

Cavitation sometimes occurs in pumps of the type described above, especially in the first stage of the pump, and most especially near the first stage discharge port. A considerable amount of noise may accompany this cavitation.

It has been found that both cavitation and the associated noise can be reduced or eliminated by augmenting the discharge port with which the cavitation is associated (usually the first stage discharge port 56 in two-stage pumps of the type shown in the drawings and described above) by providing a second, relatively small, subsidiary discharge port 130 located just beyond the closing edge of the main discharge port.

Figure 5:
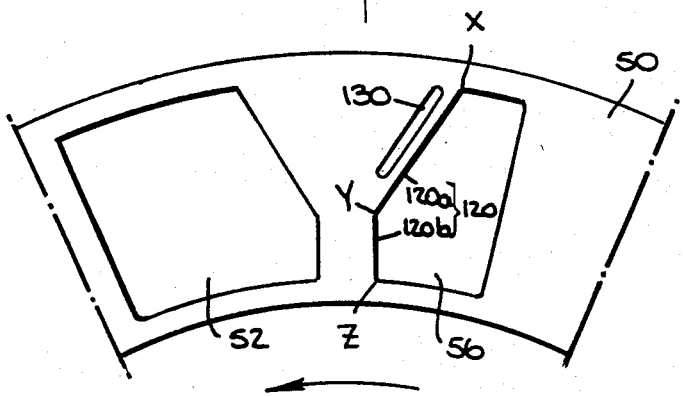
FIG. 5 is a planar projection of the frusto-conical surface of the port member shown in FIGS. 3 and 4.

In the pump configuration shown in the drawings, the closing edge 120 of discharge port 56 has two segments **120*a* and 120*b*. Segment 120*a* is inclined in the direction of rotor rotation from point X (FIG. 5) on a first relatively large circumference portion of port member 50 to point Y on a second relatively small circumference portion of port member 50. Segment 120*b* is axial (i.e., substantially coplanar with the rotational axis of rotor 30) and extends from point Y on the second relatively small circumference portion of port member 50 to point Z on a third still smaller circumference portion of port member 50. The subsidiary discharge port 130 of this invention is preferably located in the area of the surface of port member 50 which is bounded by (1) inclined closing edge segment 120*a*, (2) the first relatively large circumference of port member 50 which passes through point X, and (3) a line coincident with axial closing edge segment 120*b*. More preferably, subsidiary discharge port 130 is a longitudinal slot substantially parallel to inclined closing edge portion 120*a*. Most preferably, the slot which forms subsidiary discharge port 130 extends from the above-mentioned relatively large circumference of port member 50 to the above-mentioned line coincident with axial closing edge segment 120*b***. This most preferred embodiment is shown in the drawings.

Although in the particular embodiment shown in the drawings only one subsidiary discharge port 130 is employed, more than one such port could be employed if desired. For example, slot-shaped port 130 could be replaced by a series of circular holes, or two or more longitudinal slots, having the same orientation as slot 130 and arranged either end-to-end or side-by-side, could be used in place of single slot 130.

The subsidiary discharge port 130 of this invention preferably communicates directly with discharge conduit 58 in port member 50. Subsidiary discharge port 130 is primarily a gas discharge port, although some excess pumping liquid is also typically discharged via port 130. It has been found that the effect of subsidiary discharge port 130 is to significantly reduce cavitation and associated noise in conically ported liquid ring pumps.

Although the invention has been illustrated in its application to the first stage of conically ported two-stage liquid ring pumps, it will be understood that the invention is equally applicable to other conically ported liquid ring pump configurations, such as conically ported single-stage liquid ring pumps. For example, a conically ported single-stage liquid ring pump employing this invention could be constructed by deleting the second stage in the pump shown in the drawings and described above.

We claim:

1. A liquid ring pump comprising:

an annular housing;

a rotor rotatably mounted in the housing and having a frusto-conical bore concentric with the rotor axis; and a frusto-conical port member disposed in the bore and fixedly mounted relative to the housing, the port member including (1) an intake port, (2) a first discharge port located beyond the intake port in the direction of rotor rotation and having a closing edge including a segment which is inclined in the direction of rotor rotation from a first relatively large diameter circumference portion of the port member to a second relatively small diameter circumference portion of the port member, the first and second circumference portions being axially spaced from one another along the rotor axis, and (3) a second discharge port spaced from the first discharge port and located beyond the inclined closing edge segment but before the intake port in the direction of rotor rotation, the second discharge port being a longitudinal slot substantially parallel to the inclined closing edge segment.

2. The apparatus defined in claim 1 wherein the first and second discharge ports communicate with one another inside the port member.

3. The apparatus defined in claim 1 wherein the slot is approximately the same length as the inclined closing edge segment.

4. A liquid pump ring comprising:

an annular housing;

a rotor rotatably mounted in the housing and having a frusto-conical bore concentric with the rotor axis; and a frusto-conical port member disposed in the bore and fixedly mounted relative to the housing, the port member including (1) an intake port, (2) a first discharge port located after the intake port in the direction of rotor rotation and having a closing edge including (a) a segment which is inclined in the direction of rotor rotation from a first relatively large circumference portion of the port member to a second relatively small circumference portion of the port member and (b) an axial segment which is substantially coplanar with the rotor axis and which extends from the end of the inclined closing edge segment at the second relatively small circumference portion of the port member to a third still smaller circumference portion of the port member, and (3) a second discharge port spaced from the first discharge port and located beyond the inclined closing edge segment but before the intake port in the direction of rotor rotation.

5. The apparatus defined in claim 4 wherein the second discharge port is disposed in the area of the port member bounded by (1) the inclined closing edge segment, (2) the first relatively large circumference portion of the port member, and (3) a line coincident with the axial closing edge segment.

6. The apparatus defined in claim 5 wherein the second discharge port is a longitudinal slot substantially parallel to the inclined closing edge segment.

7. The apparatus defined in claim 6 wherein the slot extends from the first relatively large circumference portion of the port member to the line coincident with the axial closing edge segment.

* * * * *